US006361617B1

(12) United States Patent
Beijbom et al.

(10) Patent No.: US 6,361,617 B1
(45) Date of Patent: Mar. 26, 2002

(54) METHOD AND DEVICE FOR CLEANING OBJECTS

(75) Inventors: Peter Beijbom, Lund; Lars Mattis Severinsson, Hishult, both of (SE)

(73) Assignee: Drester AB, Arlov (SE)

( * ) Notice: Subject to any disclaimer, the term of this patent is extended or adjusted under 35 U.S.C. 154(b) by 0 days.

(21) Appl. No.: 09/446,773

(22) PCT Filed: Jun. 30, 1998

(86) PCT No.: PCT/SE98/01279

§ 371 Date: Dec. 23, 1999

§ 102(e) Date: Dec. 23, 1999

(87) PCT Pub. No.: WO99/01230

PCT Pub. Date: Jan. 14, 1999

(30) Foreign Application Priority Data

Jul. 3, 1997 (SE) ..... 9702566

(51) Int. Cl.[7] ..... B08B 3/00; B08B 3/02; B08B 3/04; B08B 9/00; B08B 9/027

(52) U.S. Cl. ..... 134/18; 134/22.11; 134/22.12; 134/26; 134/38; 134/56 R

(58) Field of Search ..... 134/18, 22.11, 134/22.12, 26, 38, 56 R, 57 R

(56) References Cited

FOREIGN PATENT DOCUMENTS

| | | | |
|---|---|---|---|
| EP | 0230245 | * | 7/1987 |
| EP | 0300248 | * | 1/1989 |
| EP | 0443421 | * | 8/1991 |

* cited by examiner

*Primary Examiner*—Zeinab El-Arini
(74) *Attorney, Agent, or Firm*—Tarolli, Sundheim, Covell, Tummino & Szabo L.L.P.

(57) ABSTRACT

The present invention relates to a method and a device for cleaning objects, preferably spray guns. At least one pulse counting device (9) is provided to count the number of pulses of the pulsating flow of washing liquid in a washing-liquid conduit (7) which feeds the washing liquid (3) from a washing-liquid pump (5) to at least one washing-liquid nozzle (2). The pulse counting device (9) controls at least one valve device (11) to close, in dependence of a predetermined number of pulses counted by the pulse counting device (9), a pressure-medium conduit (13) to the washing-liquid pump (5) so that the operation thereof is interrupted. Hereby, it is ensured that the desired and actual amounts or volumes of washing liquid are the same during each washing process.

22 Claims, 5 Drawing Sheets

1
2
T
2
7
5
13
A
9
11
R
K
14
13
S
B1
3

1
2
T
2
R
16
13f
A1
10
13d
12
13a
17
7
8
13e
13b
6
K
15
9
11
13
13
S2
S
5
13c
14
B2
B1
4
3

METHOD AND DEVICE FOR CLEANING OBJECTS

This is a national stage application of PCT/SE98/01279 filed Jun. 30, 1998.

The present invention relates to a method and a device for cleaning objects, preferably spray guns, whereby washing liquid is discharged by at least one washing-liquid nozzle for cleaning the object and whereby at least one pressure-medium operated, preferably compressed-air operated, washing-liquid pump is actuated for generating a pulsating flow of washing liquid in a washing-liquid conduit which is provided between said pump and said nozzle.

A prior art cleaning method for cleaning spray guns is described in EP 0 300 248. In this prior art method however, there are some drawbacks because the washing time is normally determined by pneumatic or mechanical timers. The timer starts to meter the washing time independent of if and how much washing liquid there is in the washing-liquid conduit between the washing-liquid pump and the nozzle. If e.g. said conduit is completely filled with washing liquid, washing begins immediately when the timer starts the washing-liquid pump. If however, the washing liquid conduit is not filled with washing liquid, it takes a certain time before washing begins, namely the time it takes for the washing-liquid pump to fill the washing-liquid conduit.

For the above reasons, the washing time desired by the timer and the actual washing time will not correspond, but the actual washing time will vary substantially depending on how much washing liquid there is in the washing-liquid conduit. This is not acceptable since the actual washing time thereby might be much too short for an acceptable cleaning of the spray gun.

Said difference between the desired and the actual washing time can e.g. be particularly troublesome at short washing times, e.g. during rinsing of the spray gun with clean washing liquid after having washed the spray gun with washing liquid that is recirculated. During such rinsing a short washing time is normally selected for saving pure washing liquid, inter alia because pure washing liquid is available only in limited amounts.

If the liquid conduit during this short-time rinsing of the spray gun initially is empty, then the actual washing time can only be half as long as the desired washing time, which thus might lead to a faulty cleaning of the spray gun.

An example of acceptable consumption of pure washing liquid during rinsing is in the order of 3 dl. A typical stroke volume for a washing-liquid pump often used for cleaning purposes is about 1 dl and a typical example of the frequency of such a pump is 1 stroke per second (1 Hz).

Consequently, a timer for the abovementioned rinsing should be set for 3 seconds of rinsing. It is however difficult to manufacture a pneumatic or mechnical timer with such a precision or accuracy. If e.g. the timer has a tolerance of ±2 seconds, this will give a variation in the washing-liquid consumption of ±2 dl, i.e. the consumption of washing liquid varies between 1 and 5 dl, which means an uncontrolled consumption and an uncontrolled or inaccurate washing result.

The inaccuracy with a filled or not filled washing-liquid conduit together with an inaccurate timer might thus result in a completely erroneous washing result, particularly during short time washing cycles, since the desired and actual washing-liquid amounts during each cycle will not correspond.

The object of the present invention has been to eliminate the abovementioned problem and this is arrived at by means of the method of the present invention.

Said problem is also eliminated by means of the device of the present invention.

By counting the number of pulses of the pulsating flow of washing liquid in the washing-liquid conduit and by breaking or interrupting the operation of the washing-liquid pump in dependence of a predetermined number of pulses, it is ensured that the desired and the actually discharged amount of washing liquid during each washing process are the same.

BRIEF DESCRIPTION OF THE DRAWINGS

The invention will be further described below with reference to the accompanying drawings, wherein FIG. 1 schematically illustrates a device according to the invention for cleaning objects.

DETAILED DESCRIPTION OF THE INVENTION

Figure 1:
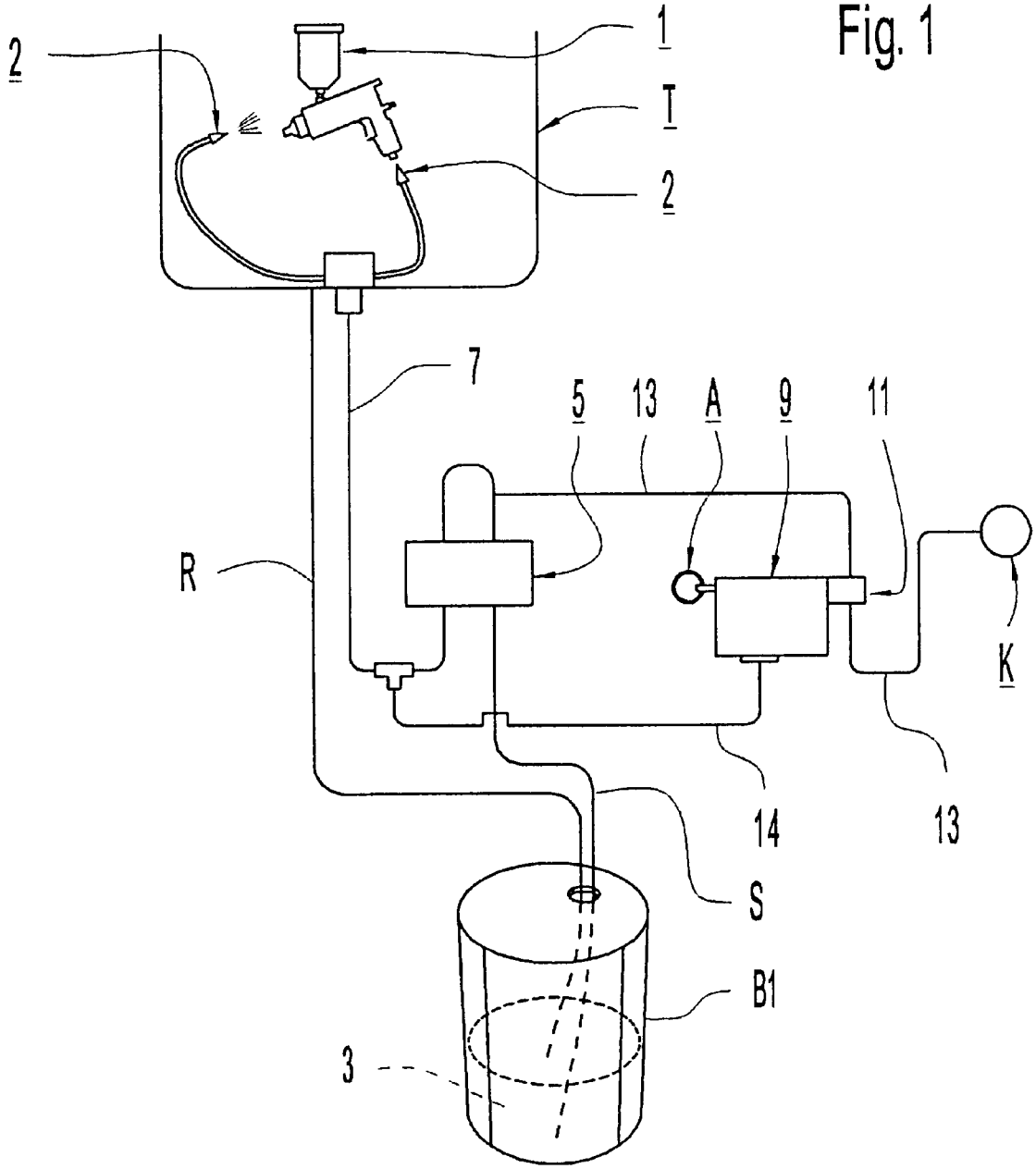

The devices illustrated in the drawings are adapted for cleaning objects, preferably spray guns 1 of e.g. the type used for enamelling cars. These spray guns 1 and eventual associated members are placed in a schematically illustrated washing chamber T having brackets (not shown) for the spray gun 1. In this washing chamber T there is/are provided one or more washing-liquid nozzles 2 which are positioned such that they discharge washing liquid 3 and/or 4 so that the spray gun 1 is washed externally and/or internally until remains of pain- adhering thereto on the outside and/or on the inside of said spray gun have been removed.

The washing liquid 3 and/or 4 can be a suitable solvent, e.g. thinner.

The cleaning device of FIG. 1 is adapted to carry out washing operations or processes for washing the spray gun with a washing liquid 3 which can be recirculated. This cleaning device includes a pressure-medium operated, preferably compressed-air operated washing-liquid pump 5, which is of so called pulsating type and which thereby generates a pulsating flow of washing liquid in a washing-liquid conduit 7 provided between said pump 5 and said nozzle or nozzles 2.

At the illustrated device, said washing process with washing liquid 3 which can be recirculated is controlled such that the desired and the actual amounts of washing liquid are the same. For this purpose, the cleaning device includes a pulse counting device 9 which controls a valve device 11, in dependence of a predetermined number of pulses counted by the pulse counting device 9, to close a pressure-medium conduit 13 for a pressure medium, preferably compressed air, which is adapted for operating the washing-liquid pump 5 such that the operation of said pump 5 and thus, the washing process, is interrupted.

The pulse counting device 9 is preferably provided to start counting pulses of the pulsating flow of washing liquid in the washing-liquid conduit 7 when said conduit 7 is filled with washing liquid 3 and a pressure therein has been developed between the washing-liquid pump 5 and the washing-liquid nozzle 2.

The washing-liquid conduit 7 and the pulse counting device 9 are preferably interconnected through a connecting conduit 14 in which the pressure increases with every pump stroke performed by the washing-liquid pump 5 and decreases with every return movement performed by said pump 5 and said pressure increase is sensed and brought to control the pulse counting device 9.

During the washing process the washing-liquid pump 5 sucks in, through a suction conduit S, washing liquid 3 which can be recirculated from a washing-liquid container B1, and this washing liquid 3 may recirculate from the washing chamber T through a return conduit R back to said container B1.

The cleaning or washing device of FIG. 1 operates so that the washing process with washing liquid 3 for recirculation is started by activating a starting device A (schematically illustrated) which cooperates with the pulse counting device 9 so that said latter device is set in a start position and so that the valve device 11 is opened. Hereby, the pressure-medium source builds up the pressure in the washing-liquid conduit 13 to the washing-liquid pump 5, which is activated and sucks washing liquid 3 to be recirculated from the washing-liquid container B1, fills the washing-liquid conduit 7 and builds up a pressure therein. When this is done, the washing process starts and the washing-liquid pulses generated thereby in the washing-liquid conduit 7 are sensed or read by the pulse counting device 9. When this device 9 has counted a predetermined number of washing-liquid pulses, the valve device 11 is controlled to close the pressure-medium conduit 13, whereby the operation of the washing-liquid pump 5 is interrupted and the washing process with washing liquid 3 which is recirculated is finished.

Figure 2:
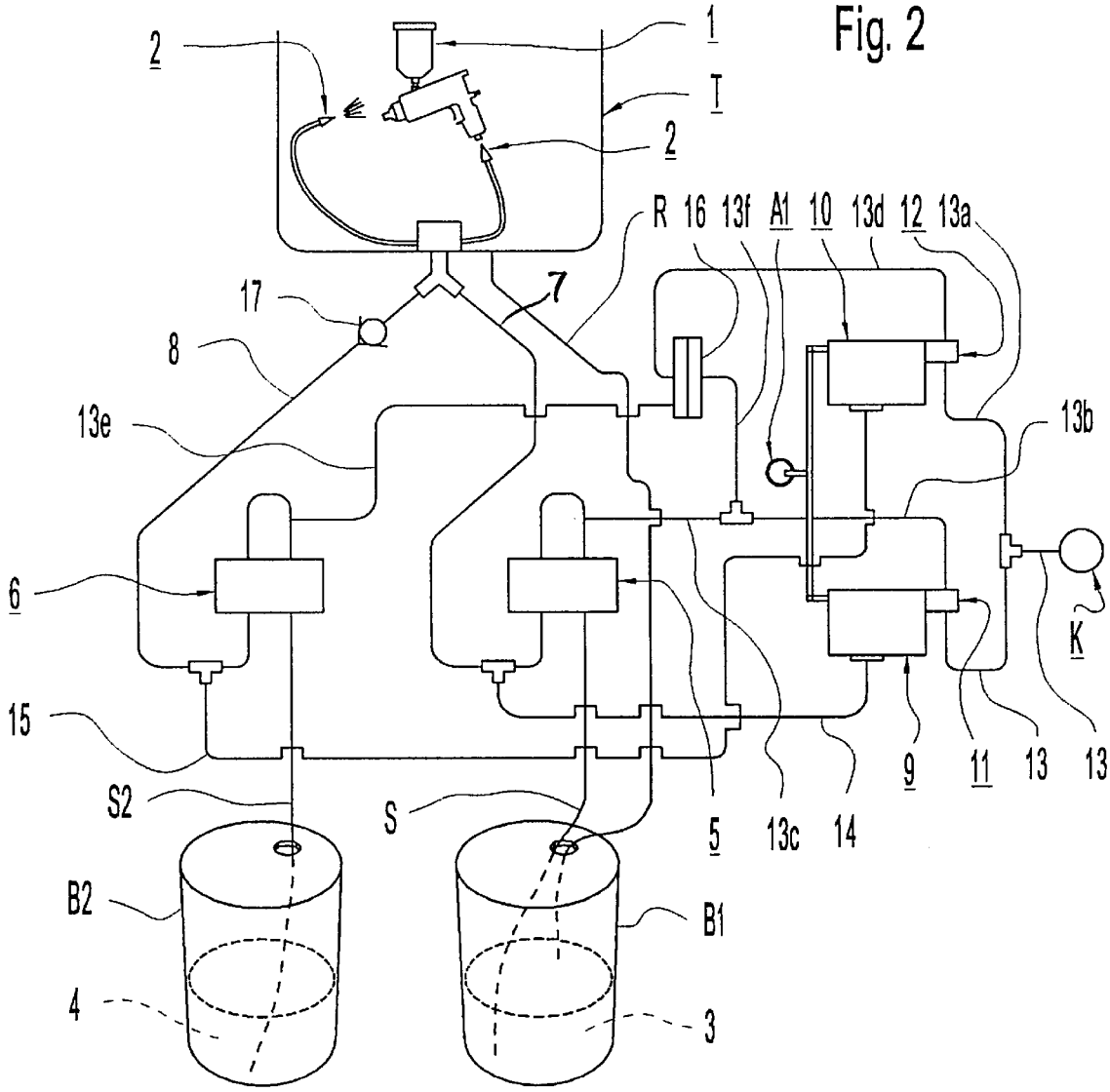
FIG. 2 schematically illustrates a device according to the invention for cleaning objects with two different washing liquids during two subsequent washing operations or processes.

The cleaning device of FIG. 2 is a device for washing the spray gun 1 with two different washing liquids in two subsequent washing processes, said washing liquids being a washing liquid 3 for recirculation and a pure washing liquid 4. These washing procedures are preferably an initial washing process with washing liquid 3 to be recirculated and thereafter a washing process with pure washing liquid 4 for rinsing the spray gun 1.

Said latter washing or cleaning device comprises substantially the same units as the cleaning device of FIG. 1 regarding the washing system for washing with washing liquid 3 for recirculation. Thus, the cleaning device of FIG. 2 includes a first pressure-medium operated, preferably compressed-air operated, washing-liquid pump 5 of such pulsating type that said pump 5 generates a pulsating flow of washing liquid in the washing-liquid conduit 7. As in the cleaning device of FIG. 1 there is also in the cleaning device of FIG. 2 a pulse counting device 9, a valve device 11, a pressure- medium conduit 13, a connecting conduit 14, a washing-liquid container B1 for washing liquid 3 for recirculation, a suction conduit S and a return conduit R. This washing system for washing liquid 3 for recirculation operates as the washing system of FIG. 1.

For rinsing the spray gun 1 with pure washing liquid 4, the cleaning device of FIG. 2 further comprises a second pressure-medium operated, preferably compressed-air operated washing-liquid pump 6 which is also of so called pulsating type and which thereby generates a pulsating flow of washing liquid in a second washing-liquid conduit 8 located between said second pump 6 and the washing-liquid nozzles 2. The rinsing process is also controlled so that the desired and the actual amounts of washing liquid become the same. This is arrived at while a second pulse counting device 10 controls a second valve device 12 to close, in dependence of a predetermined number of pulses counted by said second pulse counting device 10, a branch 13*a* of the pressure-medium conduit 13 so that the operation of the second washing-liquid pump 6 and thus, the rinsing operation or process with pure washing liquid 4, is interrupted.

The second pulse counting device 10 is preferably provided to count pulses of the pulsating flow of washing liquid in the second washing-liquid conduit 8 when said conduit 8 is filled with washing liquid 4 and a pressure therein has been built up between the second washing-liquid pump 6 and the washing nozzles 2.

The second washing-liquid conduit 8 and the second pulse counting device 10 are preferably interconnected through a connecting conduit 15 in which the pressure increases with every pump stroke performed by the second washing-liquid pump 6 and decreases with every return movement performed by said second pump 6 and said pressure increase is sensed and brought to control said second pulse counting device 10.

During the washing process for rinsing the spray gun 1 with pure washing liquid 4, the second pump 6 sucks said pure washing liquid 4 from the liquid container B2 through a suction conduit S2 and this washing liquid 4 can through the return conduit R flow from the washing chamber into the washing-liquid container B1.

The cleaning device of FIG. 2 operates so that a starting device 10 common to both pulse counting devices 9, 10 is activated such that said pulse counting devices are set in their start positions while at the same time the valve devices 11 and 12 are opened. The pressure-medium source K is thereby building up a pressure in the pressure conduit branches 13*b* and 13*c* as well as 13*f* up to the first washing-liquid pump 5 which starts, sucks washing liquid 3 which can be recirculated from the washing-liquid container B1, fills the first washing-liquid conduit 7 and builds up a pressure therein. When this is done, the washing process with washing liquid for recirculation begins and the washing-liquid pulses generated during this process in the first washing-liquid conduit 7 are read by the first pulse counting device 9 which, after having counted a predetermined number of pulses, controls or operates the first valve device 11 to close the pressure-medium conduit 13, 13*b*, 13*c* and thereby, the operation of the first washing-liquid pump 5.

During this washing process with washing liquid 3 which can be recirculated, the second washing-liquid pump 6 has not been operating. This because a blocking valve 16 is provided in the pressure-medium conduit branches 13*d*, 13*e*. This blocking valve 16 cooperates with the pressure-medium conduit 13, 13*b*, 13*c* through a connecting conduit 13*f* and is controlled by the pressure in said conduit 13, 13*b*, 13*c* to close the pressure-medium conduit 13*a*, 13*d* so that the second washing-liquid pump 6 is not set under pressure, i.e. is not started, when a pressure has been generated in the pressure-medium conduit 13, 13*b*, 13*c* and thereby, in the connecting conduit 13*f*. ohen however, the washing process with washing liquid 3 for recirculation is finished and the first valve device 11 closes the pressure-medium conduit 13, 13*b*, 13*c*, the pressure drops therein and in the connecting conduit 13f, whereby the blocking valve 16 is controlled or operated to open the pressure-medium conduit 13*a*, 13*d* to 13*e*, which results in that it is set under pressure and the second washing-liquid pump 6 started. Thus, this means that the rinsing procedure with pure washing liquid 4 is started automatically first after conclusion of the washing process with washing liquid 3 which can be recirculated.

As noted above, the second washing-liquid pump 6 will suck pure washing liquid 4 from the washing-liquid container B1, fill the second washing-liquid conduit 8 and build up or generate a pressure therein. When this is done, the rinsing process with pure washing liquid 4 commences and the washing-liquid pulses generated during this process in the second washing-liquid conduit 8 are read or sensed by the second pulse counting device 10. When this device 10 has counted a predetermined number of washing-liquid pulses, the second valve device 12 is controlled or operated to close the pressure-medium conduit 13*a*, 13*d*, 13*e*, whereby the operation of the second washing-liquid pump 6 is interrupted and the rinsing process with pure washing liquid 4 concluded.

It should also be mentioned that in the second washing-liquid conduit 8 there is provided a check valve 17 which prevents transfer of the pulses in the washing-liquid conduit 7 to the second pulse counting device 10.

Figure 3:
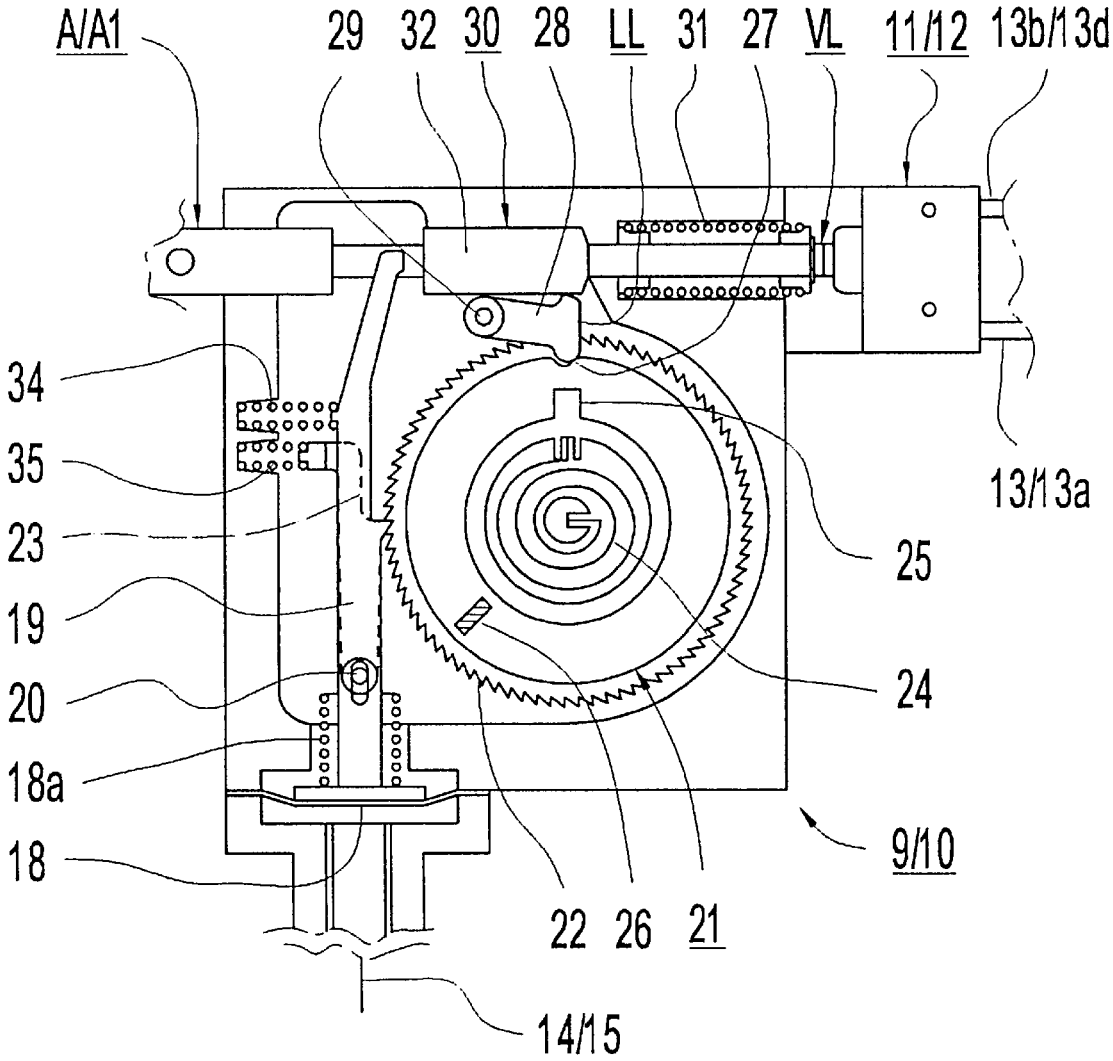
FIG. 3 is a side view of a pulse counting device forming part of the device according to the invention in a rest position.
Figure 4:
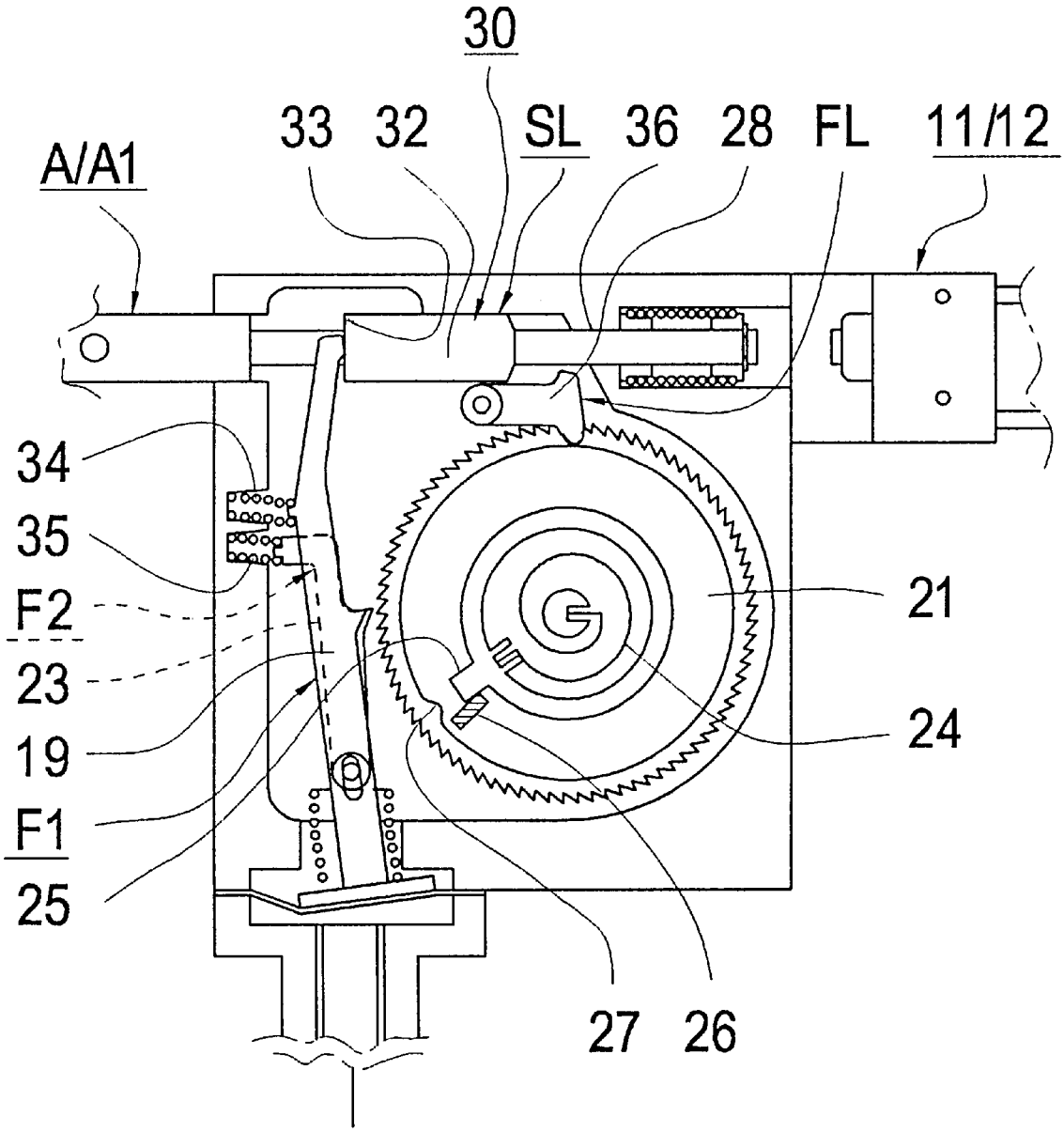
FIG. 4 illustrates the pulse counting device of FIG. 3 in a start position.
Figure 5:
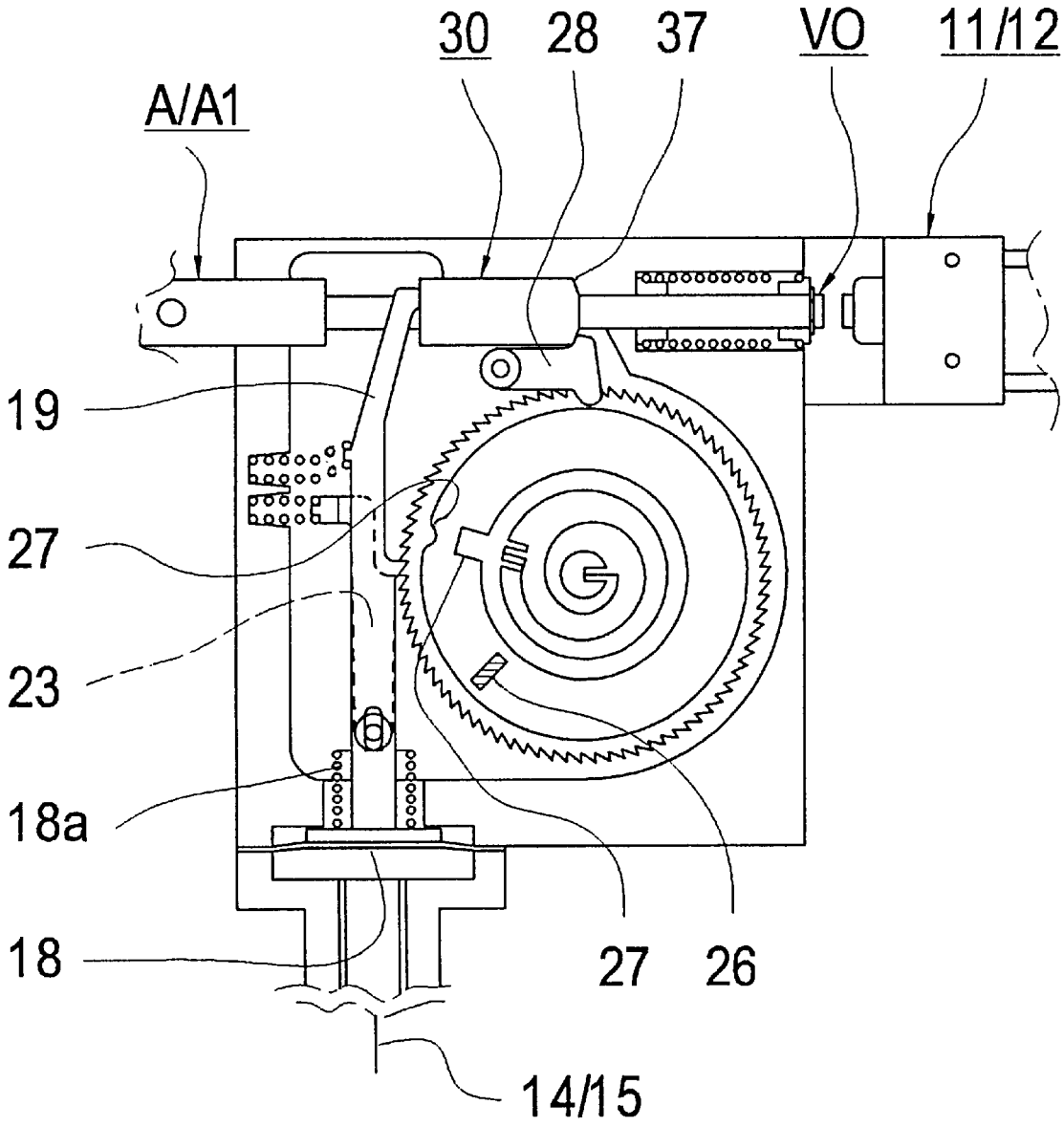
FIG. 5 illustrates the pulse counting device of FIG. 3 in a pulse counting position.

The pulse counting device 9 at the cleaning device of FIG. 1 or the pulse counting devices 9, 10 at the cleaning device of FIG. 2 is/are not electrically operated. As is shown in FIGS. 3–5, such a pulse counting device 9 and/or 10 may include a membrane or diaphragm 18 which is affected by pressure increases in the respective washing-liquid conduit 7, 8 and in the respective connecting conduit 14, 15 and in dependence thereof imparted with a pulse counting movement for each washing-liquid pulse. The diaphragm 18 cooperates with a control shoulder 19 which is displaceably and pivotally journalled on a pivot 20 and which is provided to transfer the pulse counting movements of the diaphragm 18 to a pulse counting wheel 21. Hereby, the control shoulder 19 cooperates with outer teeth 22 on the pulse counting wheel 21 so that the control shoulder 19 pivots or rotates the pulse counting wheel 21 clockwise one tooth 22 during transfer of each pulse counting movement. Hereby, a feed shoulder 23 which is pivotally mounted on the pivot 20 snaps over a tooth 22 and prevents thereby counterclockwise rotation of the pulse counting wheel 21.

After the diaphragm 18 and control shoulder 19 have transferred a pulse counting movement, said members are returned by a return spring 18*a*.

The pulse counting wheel 21 cooperates with the return spring 24 which is stretched when said wheel is rotated by the control shoulder 19. The pulse counting wheel 21 further includes a rotary stop means 25 which is provided to engage a start position means 26 when the pulse counting wheel 21 is in a start position. The start position means 26 can be set relative to the pulse counting wheel 21 such that the number of pulses in the pulse counting processes may vary. The pulse counting wheel 21 also has a recess 27, which is engageable by a lock shoulder 28 which is pivotally journalled or mounted on an axis 29.

The starting device A and A1 respectively, includes or is connected with an operating slide 30 which is displaceably mounted such that it can take a valve closing position VL (see FIG. 3) for keeping the valve device 11 and 12 respectively, closed when the pulse counting device 9 and 10 respectively, is in a rest position. The operating slide 30 cooperates with a return spring 31 which is provided to displace said slide to said valve closing position VL.

The operating or actuator slide 30 has a shoulder 32 with an edge portion 33 through which said slide can cooperate with the control shoulder 19 for setting thereof and of the feed shoulder 23 against the action of return springs 34, 35 in neutral positions F1 and F2 respectively (see FIG. 4), wherein they release the pulse counting wheel 21. The shoulder 32 is designed to keep the lock shoulder 28 in a lock position LL (see FIG. 3) wherein it engages the recess 27 in the pulse counting wheel 21 and prevents said wheel from being rotated by the return spring 24. The operating slide 30 has in front of the shoulder 32 a narrow member 36 which, when the operating slide 30 is displaced to a start position SL (see FIG. 4), permits the lock shoulder 28 to pivot out of engagement with the recess 27 to a neutral position FL (see FIG. 4) for releasing the pulse counting wheel 21 such that the return spring 24 can rotate said wheel clockwise until this rotary movement is stopped by the rotary stop means 25 abutting the start position means 26.

In FIG. 3, the pulse counting device 9 and 10 respectively, is illustrated when it is set in a rest position, whereby the return spring 24 is stretched and the valve device 11 and 12 respectively, closed. For initiating a washing process, the operating slide 30 is moved to the left until it reaches the start position SL (see FIG. 4). This displacement of the operating slide 30 provides for the following simultaneous reactions:

a) the valve device 11 and 12 respectively, is opened so that the respective washing-liquid pump 5 or 6 is set under pressure and activated;

b) the control shoulder 19 and feed shoulder 23 are pivoted to their neutral positions F1 and F2 respectively;

c) the lock shoulder 28 is pivoted from its lock position LL to the neutral position FL and the return spring 24 rotates the pulse counting wheel 21 to its start position (wherein the rotary stop means 25 engages the start position means 26).

Thereafter, the operating or actuator slide 30 is released and the pulse counting device 9 and 10 respectively, takes the pulse counting position according to FIG. 5.

When the diaphragm 18 and thereby, the control shoulder 19 are subjected to pulse counting movements, the pulse counting wheel 21 will rotate step by step in clockwise direction and the shoulder 32 on the operating slide 30 will with a front edge 37 engage the lock shoulder 28 which sees to that the operating slide 30 is set in a position VO (see FIG. 5) keeping the valve device 11 and 12 respectively, open.

When the pulse counting wheel 21 has been rotated clockwise a predetermined number of steps corresponding to the predetermined number of pulses, the recess 27 will be in a position opposite the lock shoulder 28 so that said shoulder is pressed down into said recess 27 by means of the shoulder 32 and the return spring 31 affecting the operating slide 30. This spring 31 will displace the operating slide 30 (to the right) to its valve closing position VL (see FIG. 3), resulting in that the valve device 11 and 12 respectively, is closed and the operation of the respective washing-liquid pump 5 or 6 interrupted.

Then, the abovementioned start function maybe repeated so that the pulse counting device 9 and 10 respectively, carry out the same moments in the same order.

The method and device described above may vary within the scope of the following claims. As examples of methods not further described, it can be mentioned that the pulse counting may occur in other ways and in other locations than described and regarding the described device it should be mentioned that the pulse counting devices may have an entirely different construction than those described and there may be another number of pulse counting devices depending on the number of washing processes with different amounts or volumes of washing liquid to be carried through.

Finally, it should be mentioned that the method and device described may be used for cleaning other objects than spray guns and eventual associated members, that the cleaning device illustrated in FIG. 1 may be used for washing with pure washing liquid instead of such liquid for recirculation and that there may be one or another appropriate number of washing-liquid nozzles for discharging the washing liquid.

What is claimed is:

1. Method for cleaning objects, the method comprising the steps of:

discharging washing liquid (3) from at least one washing-liquid nozzle (2) for cleaning an object;

actuating at least one pressure-medium operated washing-liquid pump (5) for generating a pulsating flow of washing liquid in a washing-liquid conduit (7) which is provided between said pump (5) and said nozzle (2);

counting a number of pulses of the pulsating flow of washing liquid in the washing-liquid conduit (7); and interrupting operation of the washing-liquid pump (5) upon counting a predetermined number of pulses.

2. Method according to claim 1, further including the step of:

beginning to count the number of pulses of the pulsating flow of washing liquid in the washing-liquid conduit (7) when said conduit (7) is filled with washing liquid and when a pressure has been generated therein.

3. Method according to claim 1, wherein the step of interrupting operation of the washing-liquid pump (5) is further defined by the step of:

closing a pressure-medium conduit (13) for providing a pressure-medium for operating said pump (5).

4. Method according to claim 3, further including the step of:

controlling a valve device (11) to close the pressure-medium conduit (13) when a predetermined number of pulses of the pulsating flow of washing liquid in the washing-liquid conduit (7) has been counted.

5. Method according to claim 1, wherein the step of counting the number of pulses of the pulsating flow of washing liquid in the washing-liquid conduit (7) is further defined by the step of:

operating a pulse counting device (9).

6. Method according to claim 5, further including the step/of:

automatically resetting the pulse counting device (9) for counting a number of pulses in a subsequent pulse counting procedure after having counted a number of pulses in a pulse counting procedure.

7. Method according to claim 6, further including the step of:

varying the number of pulses to be counted in each pulse counting procedure.

8. Method according to claim 1, wherein the step of counting the number of pulses of the pulsating flow of washing liquid in the washing-liquid conduit (7) is further defined by the steps of:

increasing the pressure in a connecting conduit (14) between said washing-liquid conduit (7) and a pulse counting device (9) with every washing liquid pulse; and causing every pressure increase in said connecting conduit (14) to affect said pulse counting device (9).

9. Method according to claim 1, wherein the step of counting the number of pulses of the pulsating flow of washing liquid in the washing-liquid conduit (7) is further defined by the steps of:

producing a pulse counting movement on a diaphragm (18) forming part of a pulse counting device (9) with every washing-liquid flow pulse in the washing-liquid conduit (7); transferring said pulse counting movement to a pulse counting wheel (21) forming part of the pulse counting device (9), said wheel being rotated in dependence of every pulse counting movement;

stretching a return spring (24) forming part of the pulse counting device (9) when the pulse counting wheel (21) is rotated in dependence of the pulse counting movement;

controlling a valve device (11) to close a pressure-medium conduit (13) for pressure medium for operating the washing-liquid pump (5) so that operation of the washing-liquid pump (5) is interrupted when the pulse counting wheel (21) has been rotated in dependence of a predetermined number of counted pulses; and resetting the pulse counting wheel (21) by the return spring (24) to a start position when the pulse counting device (9) is activated for a new pulse counting procedure.

10. Method according to claim 1, further including the steps of:

recirculating washing liquid (3) used to wash the object (1) during a first washing process; and supplying pure washing liquid (4) to wash the object (1) during a second washing process.

11. Method according to claim 10, further including the step of:

automatically initiating said second washing process when the first washing process has been completed.

12. Method according to claim 10, further including the steps of:

activating at least one first pressure-medium operated washing-liquid pump (5) for generating a pulsating flow of washing liquid (3) in a first washing-liquid conduit (7) provided between said first pump (5) and at least one washing-liquid nozzle (2);

discharging the washing liquid (3) during the first washing process from said nozzle (2) for washing the object (1) with said washing liquid (3);

counting the number of pulses of the pulsating flow of washing liquid (3) in said first washing-liquid conduit (7) during washing of the object (1) with washing liquid (3);

interrupting the operation of said first washing-liquid pump (5) and thereby, the first washing process, in dependence of a predetermined number of counted pulses of the pulsating flow of washing liquid in said first washing-liquid conduit (7);

activating at least one second pressure-medium operated washing-liquid pump (6) for generating a pulsating flow of pure washing liquid (4) in a second washing-liquid conduit (8) provided between said second pump (6) and said nozzle (2);

discharging the pure washing liquid (4) during the second washing process from said nozzle (2) for rinsing the object (1) with said pure washing liquid (4);

counting the number of pulses of the pulsating flow of washing liquid in said second washing-liquid conduit (8) during washing of the object (1) with pure washing liquid (4); and interrupting the operation of said second washing-liquid pump (6) and thereby, the second washing process, in dependence of a predetermined number of counted pulses of the pulsating flow of washing liquid in said second washing-liquid conduit (8).

13. Method according to claim 1, wherein the step of counting the number of pulses of the pulsating flow of washing liquid in the washing-liquid conduit (7) is further defined by the step of:

operating a non-electrically operated pulse counting device (9).

14. Device for cleaning objects comprising:

at least one washing-liquid nozzle (2) for discharging washing liquid (3) for cleaning an object (1);

at least one pressure-medium operated washing liquid pump (5) for generating a pulsating flow of washing liquid in a washing-liquid conduit (7) which is provided between said pump (5) and said nozzle (2);

at least one pulse counting device (9) to count a number of pulses of the pulsating flow of washing liquid in the washing-liquid conduit (7); and at least one valve device (11) that is controlled by the pulse counting device (9) to close, in dependence of a predetermined number of pulses counted by the pulse counting device (9), a pressure-medium conduit (13) for operating the washing-liquid pump (5) so that the operation of the washing-liquid pump (5) is interrupted.

15. Device according to claim 14, wherein the pulse counting device (9) is provided to start counting pulses of the pulsating flow of washing liquid in the washing-liquid conduit (7) when said conduit is filled with washing liquid (3) and a pressure has been generated therein.

16. Device according to claim 14, wherein the pulse counting device (9) has a return spring (24) for automatically resetting said pulse counting device (9) when said device has counted a number of pulses in a pulse counting procedure, so that said pulse counting device (9) can count a number of pulses in a subsequent pulse counting procedure.

17. Device according to claim 14, wherein the device includes means (2, 5, 9, B1) for washing the object (1) with washing liquid (3) which can be recirculated during a first washing process, and means (2, 6, 10, B2) for washing the object (1) with pure washing liquid (4) during a second washing process.

18. Device according to claim 17, wherein at least one first pressure-medium operated washing-liquid pump (5) is provided to generate a pulsating flow of washing liquid, consisting of washing liquid (3), which can be recirculated, in a first washing-liquid conduit (7) provided between said first pump (5) and said nozzle (2);

at least one second pressure-medium operated washing-liquid pump (6) is provided to generate a pulsating flow of washing liquid, consisting of pure washing liquid (4), in a second washing-liquid conduit (8) provided between said second pump (6) and said nozzle (2);

a first pulse counting device (9) is provided to count the number of pulses of the pulsating flow of washing liquid (3) in said first washing-liquid conduit (7);

said first pulse counting device (9) controls at least one first valve device (11) to close, in dependence of a predetermined number of counted pulses, a first pressure-medium conduit (13) for pressure medium for operating the first washing-liquid pump (5), so that the operation thereof and thereby, the first washing process is interrupted;

a second pulse counting device (10) is provided to count the number of pulses of the pulsating flow of pure washing liquid (4) in the second washing-liquid conduit (8); and said second pulse counting device (10) controls at least one second valve device (12) to close, in dependence of a predetermined number of counted pulses, a second pressure-medium conduit (13*a*) for operating the second washing-liquid pump (6) so that the operation thereof and thereby the second washing process is interrupted.

19. Device according to claim 18, characterized in the first and second pulse counting devices (9 and 10) are simultaneously located in start positions;

the first and second valve devices (11 and 12) are controlled by the first and second pulse counting devices (9 and 10) respectively, to open a first and second pressure-medium conduit (13 and 13*a*) for pressure medium for operating the first and second washing-liquid pumps (5 and 6) respectively; and a blocking valve (16) is provided in the second pressure-medium conduit (13*a*), said blocking valve (16) being controlled to close the second pressure-medium conduit (13*a*) to the second washing-liquid pump (6) through influence from pressure-medium pressure in the first pressure-medium conduit (13) so that said second washing-liquid pump (6) is not operative when the first washing-liquid pump (5) is operating, and said blocking valve (16) further being controlled to open the second pressure-medium conduit (13*a*) while its influence on the pressure-medium pressure in the first pressure-medium conduit (13) ceases, so that the second washing-liquid pump (6) is operative when the first washing-liquid pump (5) is inoperative.

20. Device according to claim 14, wherein the pulse counting device (9) includes a diaphragm (18) which is affected with a pulse counting movement by every washing-liquid flow pulse in the washing-liquid conduit (7);

a control shoulder (19) is provided to transfer the pulse counting movement of the diaphragm (18) to a pulse counting wheel (21) and to rotate said wheel in dependence of each pulse counting Movement;

a return spring (24) is provided to be stretched by rotation of the pulse counting wheel (21), and release means (30) for closing the valve device (11) for closing the pressure-medium conduit (13) to the washing liquid pump (5) and thereby interrupting operation of said pump (5) after rotation of the pulse counting wheel (21) by a predetermined number of counted pulses.

21. Device according to claim 20, wherein a lock shoulder (28) is provided for releasing the pulse counting wheel (21) when a starting device (A) is activated so that the return spring (24) can reset the pulse counting wheel (21) to a start position.

22. Device according to claim 14, wherein the pulse counting device (9) is non-electrically operated.

* * * * *